US011408296B2

(12) United States Patent
Simonds et al.

(10) Patent No.: US 11,408,296 B2
(45) Date of Patent: Aug. 9, 2022

(54) VANE STAGES

(71) Applicant: UNITED TECHNOLOGIES CORPORATION, Farmington, CT (US)

(72) Inventors: Mark E. Simonds, Cape Neddick, ME (US); Steven J. Feigleson, Falmouth, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/272,175

(22) Filed: Feb. 11, 2019

(65) Prior Publication Data

US 2020/0024992 A1 Jan. 23, 2020

Related U.S. Application Data

(62) Division of application No. 14/616,274, filed on Feb. 6, 2015, now Pat. No. 10,202,857.

(51) Int. Cl.
*F01D 9/04* (2006.01)
*F01D 11/00* (2006.01)
(Continued)

(52) U.S. Cl.
CPC ..... *F01D 9/041* (2013.01); *F01D 11/001* (2013.01); *F01D 11/003* (2013.01);
(Continued)

(58) Field of Classification Search
USPC ..... 411/101; 415/173.7, 210.1
See application file for complete search history.

(56) References Cited

U.S. PATENT DOCUMENTS 160,862 A * 3/1875 Adgate ..... F16B 39/24 411/101
2,738,949 A ‡ 3/1956 Wilfred ..... F01D 9/041 415/11
(Continued)

FOREIGN PATENT DOCUMENTS

EP 0945597 A1 ‡ 9/1999 ..... F01D 9/042
EP 0945597 A1 9/1999
(Continued)

OTHER PUBLICATIONS

European Search Report and Communication; Application No. 16154554.6-1610/3054104; Dated Nov. 18, 2016; 12 pages.‡
(Continued)

*Primary Examiner* — Robert K Arundale
*Assistant Examiner* — Richard K. Durden
(74) *Attorney, Agent, or Firm* — Cantor Colburn LLP

(57) ABSTRACT

A vane stage includes an arcuate platform defining an axial centerline axis having a pair of flanges that extend radially inward from the platform. The flanges are axially spaced from one another and from respective forward and aft ends of the platform. The vane stage includes a vane extending radially outward from the platform and a seal carrier mounted to the flanges of the platform. A method for constructing a vane stage includes sliding a seal carrier between flanges of an arcuate platform. Each flange includes at least a pair of through holes and interfaces with a respective axial side of the seal carrier. The method includes drilling through holes in each axial side of the seal carrier by using the through holes of each flange as guides.

13 Claims, 2 Drawing Sheets

(51) Int. Cl.
*F01D 25/24* (2006.01)
*F01D 25/00* (2006.01)

(52) U.S. Cl.
CPC ..... *F01D 25/005* (2013.01); *F01D 25/246* (2013.01); *F01D 25/243* (2013.01); *F05D 2220/32* (2013.01); *F05D 2230/10* (2013.01); *F05D 2230/60* (2013.01); *F05D 2240/12* (2013.01); *F05D 2240/55* (2013.01); *F05D 2240/80* (2013.01); *F05D 2300/133* (2013.01); *F05D 2300/603* (2013.01)

(56) References Cited

U.S. PATENT DOCUMENTS 2,868,439 A * 1/1959 Hampshire ..... F01D 5/282 415/141
3,275,294 A ‡ 9/1966 Allen ..... F01D 5/081 415/115
3,411,794 A * 11/1968 Allen ..... F16J 15/444 277/414
3,727,660 A * 4/1973 Burge ..... F16B 41/002 411/337
3,941,500 A * 3/1976 Glenn ..... F01D 11/025 415/136
3,945,758 A ‡ 3/1976 Lee ..... F01D 5/187 415/14
4,113,406 A ‡ 9/1978 Lee ..... F01D 11/001 415/11
4,380,413 A * 4/1983 Dewey ..... F16B 43/02 411/161
4,869,640 A ‡ 9/1989 Schwarz ..... F01D 5/081 415/11
4,897,021 A ‡ 1/1990 Chaplin ..... F01D 5/22 267/160
5,482,433 A ‡ 1/1996 Norris ..... F01D 5/22 415/173.7
5,599,131 A * 2/1997 Julen ..... F16B 43/00 403/312
5,601,407 A * 2/1997 Humhauser ..... F01D 11/001 415/209.2
6,220,815 B1 * 4/2001 Rainous ..... F01D 11/001 415/174.5
6,425,738 B1 ‡ 7/2002 Shaw ..... F01D 9/041 415/208.1
7,494,317 B2 * 2/2009 Keller ..... F01D 11/025 415/136
7,722,317 B2 * 5/2010 Schiavo ..... F01D 25/246 415/138
7,963,034 B2 * 6/2011 Dejaune ..... F01D 5/066 29/889.3
8,162,597 B2 * 4/2012 LeJars ..... F01D 17/162 415/160
8,297,934 B2 ‡ 10/2012 Lutz ..... F01D 5/14 415/200
8,454,303 B2 ‡ 6/2013 Garcia-Crespo ..... F01D 9/042 415/137
8,740,556 B2 ‡ 6/2014 Papin ..... F01D 9/041 415/189
9,453,425 B2 ‡ 9/2016 Brummitt-Brown ... F01D 9/045
9,587,517 B2 * 3/2017 Vetters ..... F01D 11/08
9,702,395 B2 * 7/2017 Harger ..... F16B 43/00
2007/0065286 A1 ‡ 3/2007 Bolgar ..... F01D 11/001 416/193 A
2008/0242129 A1 * 10/2008 Younce ..... H01R 4/64 439/100
2009/0185896 A1 ‡ 7/2009 Kizuka ..... F01D 5/081 415/11
2010/0068034 A1 ‡ 3/2010 Schiavo ..... F01D 5/189 415/115
2011/0150640 A1 ‡ 6/2011 Tiemann ..... F01D 5/3015 415/19
2013/0011253 A1 * 1/2013 Mulcaire ..... F01D 25/243 415/214.1
2013/0259673 A1 ‡ 10/2013 Waki ..... F01D 25/00 415/208.1
2014/0227088 A1 ‡ 8/2014 Beaujard ..... F01D 5/282 415/17
2015/0086331 A1 ‡ 3/2015 Hess ..... F01D 9/04 415/111
2016/0069199 A1 * 3/2016 Duelm ..... F01D 9/042 415/209.3
2016/0115800 A1 ‡ 4/2016 Lyders ..... F01D 9/02 415/208.1
2016/0230574 A1 8/2016 Simonds
2016/0305265 A1 ‡ 10/2016 Stapleton ..... F04D 29/321
2017/0306776 A1 ‡ 10/2017 Simonds ..... F01D 25/243
2017/0335701 A1 ‡ 11/2017 Biolsi ..... F01D 9/042

FOREIGN PATENT DOCUMENTS

FR 2979662 A1 ‡ 3/2013 ..... F01D 5/282
FR 2979662 A1 3/2013
GB 853997 A ‡ 11/1960 ..... F01D 9/044
GB 853997 A 11/1960
GB 2110768 A ‡ 6/1983 ..... F01D 9/042
GB 2110768 A 6/1983
WO 2014004017 A1 1/2014
WO WO-2014004017 A1 ‡ 1/2014 ..... F04D 29/60

OTHER PUBLICATIONS

English Machine Translation for EP0945597.‡
English Abstract Translation for EP0945597.‡
English Abstract Translation for FR 979662.‡
Sprovieri, John. "Best Practices for Press-Fit Assembly." Assembly Magazine, Feb. 8, 2005, www.assemblymag.com/articles/84160-running-interference. Accessed Sep. 17, 2017.‡

* cited by examiner
‡ imported from a related application

VANE STAGES

CROSS REFERENCE TO RELATED APPLICATION

This application is a divisional of U.S. patent application Ser. No. 14/616,274 filed on Feb. 6, 2015, the entire contents of which are incorporated herein by reference thereto.

STATEMENT REGARDING FEDERALLY SPONSORED RESEARCH OR DEVELOPMENT

This invention was made with government support under contract number N00019-02-C-3003 awarded by the United States Department of Defense. The government has certain rights in the invention.

BACKGROUND OF THE INVENTION

1. Field of the Invention

The present disclosure relates to turbomachine components, such as stator vane stages and vane support systems in gas turbine engines.

2. Description of Related Art

Traditionally, gas turbine engines can include multiple stages of vanes to condition and guide airflow through the fan, compressor and/or turbine sections. The vane stages are configured to optimize airflow characteristics for various operating conditions. The vane stages are subject to high temperatures, aerodynamic loading and pressures that can affect their durability.

It is expected that this will be exacerbated due to the ongoing trend of designing gas turbine engines to operate at even higher temperatures and pressures. As such, there is still a need in the art for improved vane stages that can operate at high temperatures while still providing the desired stiffness and ease of manufacture.

SUMMARY OF THE DISCLOSURE EMBODIMENTS

A vane stage includes an arcuate platform defining a axial centerline axis having a pair of flanges that extend radially inward from the platform. The flanges are axially spaced from one another and from respective forward and aft ends of the platform. The vane stage includes a vane extending radially outward from the platform and a seal carrier mounted to the flanges of the platform.

The axial distance between the flanges can range from 63% to 77% of the chord length of the vane. The axial distance between the flanges can range from 56% to 84% of the chord length of the vane. One of the flanges proximate to the forward end of the platform can be axially spaced apart from the forward end of the platform the same distance as the other flange proximate to the aft end of the platform is axially spaced apart from the aft end of the platform. The seal carrier can be mounted axially between the flanges. The vane and platform can be made from titanium, and/or the seal carrier can be made from composite. The vane and platform can be co-fabricated.

The seal carrier can be one of a plurality of arcuate seal carriers. Each arcuate seal carrier can include a neck portion at one end that extends in a circumferential direction to nest within an end of a neighboring arcuate seal carrier. Axial outwardly facing sides of each neck portion can be in an interference fit with corresponding axial inwardly facing sides of the neighboring seal carrier in which each neck portion rests.

In accordance with other embodiments, a vane stage includes a washer mounted to the seal carrier. The washer is opposite of one of the flanges of the platform across the axial thickness of a side of the seal carrier. A portion of the seal carrier between the washer and flange can include at least two through holes in an axial direction for receiving respective fasteners. The washer can include a pair of through holes that correspond to respective pairs of holes in the platform flanges and the seal carrier. A cross-sectional area of the washer surface that interfaces with the seal carrier can be at least eight times greater in area than the total cross-sectional area of through holes in the portion of the seal carrier that the washer surface interfaces with. The washer can have a race-track shape.

In accordance with another embodiment, a method for constructing a vane stage includes sliding a seal carrier between flanges of an arcuate platform. Each flange includes at least a pair of through holes and interfaces with a respective axial side of the seal carrier. The method includes drilling through holes in each axial side of the seal carrier by using the through holes of each flange as guides. The method can include securing the axial sides of the seal carrier to respective flanges with fasteners inserted through the through holes of the flanges and the seal carrier. Securing the axial sides of the seal carrier to respective flanges can include placing a washer opposite each flange across the seal carrier.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
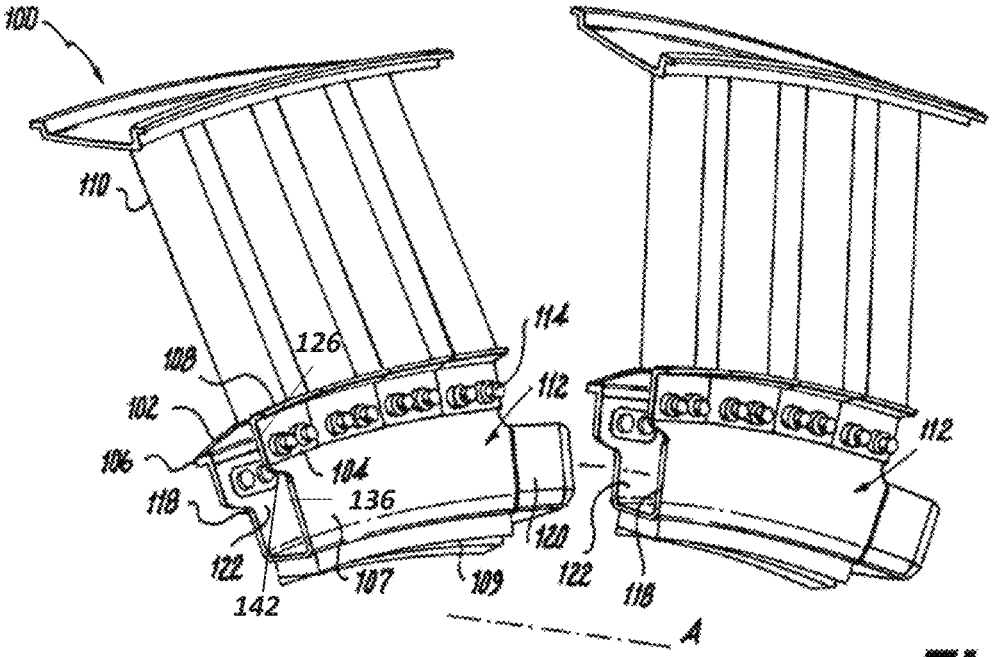
FIG. 1 is a perspective exploded view of an exemplary embodiment of a portion of a vane stage constructed in accordance with the present disclosure, showing sides of a seal carrier mounted between a washer and a flange of a vane platform.

Reference will now be made to the drawings wherein like reference numerals identify similar structural features or aspects of the subject disclosure. For purposes of explanation and illustration, and not limitation, a perspective view of an exemplary embodiment of a portion of a vane stage for a gas turbine engine constructed in accordance with the disclosure is shown in FIG. 1 and is designated generally by reference character 100. Other embodiments of vane stages constructed in accordance with the disclosure, or aspects thereof, are provided in FIGS. 2-4, as will be described. A vane stage as shown and described herein can be used in a variety of gas turbine engines, for example low bypass ratio gas turbine engines or high bypass ratio gas turbine engines, such as in the second vane stage of a fan section of a low bypass ratio gas turbine engine. Embodiments of vanes stages shown and described herein provide improved operation at high temperatures while still having the desired stiffness, and ease of manufacture.

Figure 3:
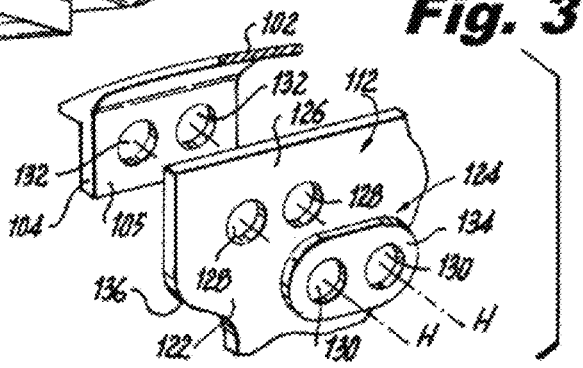
FIG. 3 is a perspective exploded view of a portion of the vane stage of FIG. 1, showing the through holes of the washer, seal carrier and flange.

As shown in FIG. 1, vane stage 100 includes a plurality of arcuate platforms 102 circumferentially arranged to form an annulus. Each arcuate platform 102 defines a axial centerline axis A. A pair of flanges 104 extend radially inward from each platform 102. Flanges 104 are axially spaced from one another and from respective forward and aft ends 106 and 108, respectively, of platform 102. Vane stage 100 includes vanes 110 extending radially outward from respective platforms 102 and a seal carrier 112 mounted with fasteners 114 to flanges 104 of platforms 102. Seal carrier 112 is mounted axially between flanges 104 so that inner surfaces 105, one of which is shown in FIG. 3, of flanges 104, interface with outer surfaces 107 of seal carrier 112. A seal 109 extends radially inward from carrier 112 for interfacing with a rotor disk, not shown. It is contemplated that a variety of suitable fasteners 114 can be used, for example, HI-LOK® pin rivets and shear collars available from Hi-Shear Corporation of Torrance, Calif.

With continued reference to FIG. 1, vane stage 100 allows for vanes 110 and platforms 102 to be separately formed and then joined together with seal carrier 112. This permits vane 110 and platform 102 to be made from titanium, while seal carrier 112 can be made from a composite material, contrary to traditional configurations where the vanes, platforms and seal carrier are co-fabricated from composite material. High temperatures and pressures tend to be challenging for composite materials, especially for use in components under high aerodynamic loading, such as vanes 110. Vane stage 100 effectively joins titanium vanes and platforms, for example, vanes 110 and platforms 102, to a composite seal carrier, for example, seal carrier 112, providing the durability for high loads and high temperatures but allows use of lightweight composite for the relatively lower stressed seal carrier of the vane stage. Vane 110 and platform 102 are shown as being co-fabricated, however those skilled in the art will readily appreciate that vane 110 and platform 102 can be formed separately from titanium or other suitable materials.

Vane stage 100 allows vanes 110 and platforms 102 to be joined to seal carrier 112 without the need for adhesives and without the need for bushings adhered to the composite. Adhesives are generally are not capable of operating at high operating temperatures and bushings tend to add weight to the vane stage assembly and tend to increase manufacturing complexity. Additionally, vane stage 100 overcomes traditional problems with using fasteners such as limitations to hole alignment and drilling, and slippage under low flange stack compression and access to fasteners inside the seal carrier.

Figure 2:
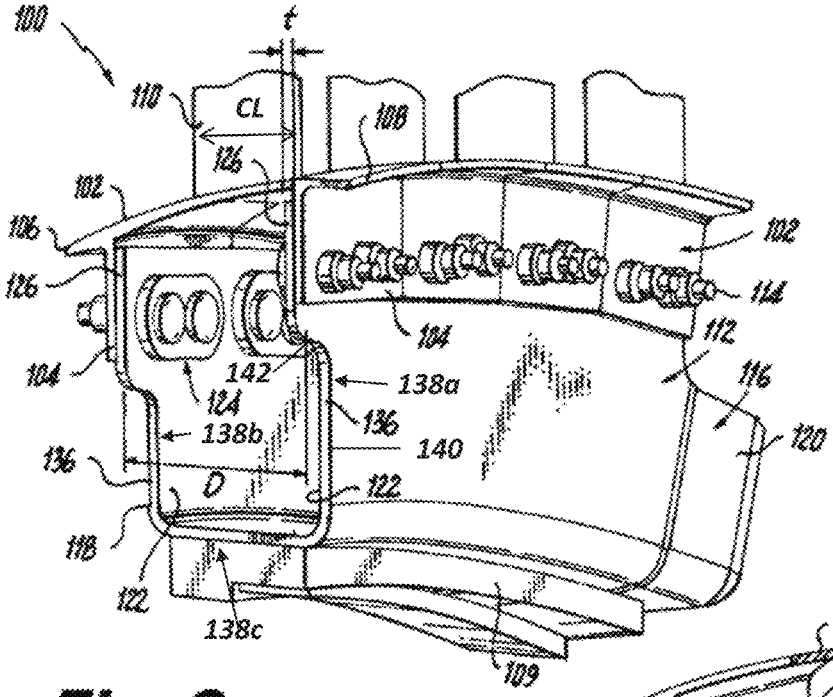
FIG. 2 is a perspective view of a portion of the vane stage of FIG. 1, showing the fasteners securing the seal carrier, flanges and washers together.

As shown in FIG. 2, an axial distance D between flanges 104 can range from 56% to 84% of the chord length, CL, of one of vanes 110. Preferably, axial distance D between flanges 104 can range from 63% to 77% of the chord length, CL or more particularly, axial distance D can be 70% of the chord length, CL, of one of vanes 110. One of flanges 104 on each of the platforms 102 proximate to forward end 106 of the platform is axially spaced apart from forward end 106 of the platform the same distance as the other flange 104 proximate to aft end 108 of platform 102 is axially spaced apart from aft end 108 of platform 102. The spacing between pairs of flanges 104 relative to the chord length of respective vane 110 provides stiffness for vibration tuning.

With reference now to FIGS. 2 and 3, vane stage 100 includes washers 124 mounted to the seal carrier. Each washer 124 is opposite of one of flanges 104 of platform 102 across the axial thickness t of one of sides 136 of seal carrier 112. A portion 126 of seal carrier 112 between each washer 124 and flange 104 includes two through holes 128 in an axial direction for receiving respective fasteners 114. Each washer 124 includes a pair of through holes 130 that correspond to respective pair of holes 132 in flanges 104 and to through holes 128 of seal carrier 112. Those skilled in the art will readily appreciate that through holes 128 are positioned in seal carrier 112 such that only a few fasteners are required to carry the prying load from differential pressure across seal carrier 112, and the vane over-turning moments caused by aerodynamic gas loads acting on vanes 110 and platforms 102.

With continued reference to FIG. 3, a cross-sectional area of each washer surface that interfaces with seal carrier 112, for example, the surface opposite that of washer surface 134, is at least eight times greater in area than the total cross-sectional area of through holes 128 that the respective washer surface interfaces with, for example, the cross-sectional area of two holes 128. The cross-sectional area of each through hole 128 is taken perpendicular to respective hole axes H. Each washer 124 assists in spreading out fastener 114 pre-load over respective axial inwardly facing sides 122 of carrier 112. Those skilled in the art will readily appreciate that while washers 124 are shown as having a race-track shape, washers 124 can take any suitable shape, such as, oval, rectangular, egg, round, and/or the like. It is also contemplated that washers 124 can be divided into separate washer portions that make up a similar shape as those described above.

As shown in FIGS. 1 and 2, seal carrier 112 is one of a plurality of arcuate seal carriers. Each arcuate seal carrier 112 includes a neck portion 116 at one end that extends in a circumferential direction to nest within an end 118 of a neighboring arcuate seal carrier 112, ultimately forming a seal carrier ring. Axial outwardly facing sides 120 of neck portion 116 are interference fit with corresponding axial inwardly facing sides 122 of the neighboring seal carrier 112 in which each neck portion 116 rests. The interference fit between respective axial outwardly facing sides 120 of neck portion 116 and axial inwardly facing sides 122 of neighboring carrier 112 provides durability and vibration control for the seal carrier ring. Each seal carrier 112 includes a first leg 138*a* or side 136 defining a first axial inwardly facing side 122 and a first axial outwardly facing side 120, a second leg 138*b* or side 136 disposed opposite the first leg 138*a* defining a second axial inwardly facing side 122 and a second axial outwardly facing side 120, and a base 138*c* from which the first leg 138*a* and the second leg 138*b* radially extend. The first leg 138*a* or side 136, the second leg 138*b* or side 136, and the base 138*c* circumferentially extend between the neck portion 116 at one end and the end 118. At the end 118 of the seal carrier 112 opposite the neck portion 116, each of the first leg 138*a* or side 136 and the second leg 138*b* or side 136 include the portion 126 that is disposed parallel to the flange 104, a second portion 140 disposed parallel to and not coplanar with the portion 126, and a third portion 142 extending between and disposed in a non-parallel relationship with the portion 126 and the second portion 140.

Figure 4:
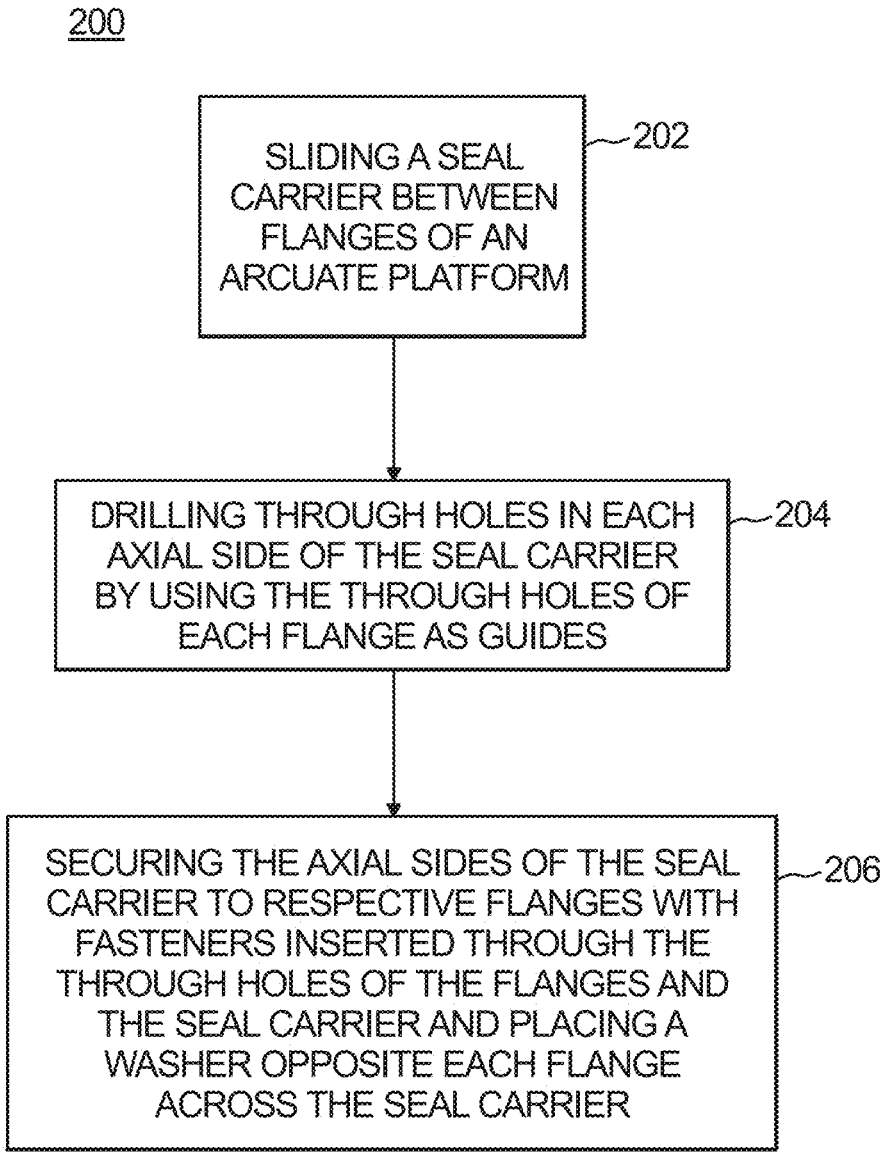
FIG. 4 is a method for constructing a vane stage, schematically showing the method.

With reference now to FIG. 4, method 200 for constructing a vane stage, for example, vane stage 100, includes sliding a seal carrier, for example, seal carrier 112, between flanges, for example, flanges 104, of an arcuate platform, for example, arcuate platform 102, as shown in box 202. Each flange includes at least a pair of through holes, for example, through holes 132, and interfaces with a respective axial side, for example, side 136, of the seal carrier. Method 200 includes drilling through holes, for example, through holes 128, in each axial side of the seal carrier by using the through holes, for example, through holes 132, of each flange as guides, for example, transfer drilling, as shown in box 204. By assembling the vane stage with the flanges placed on outer surfaces, for example, outer surfaces 107, of the seal carrier and using the through holes of each flange as guides, the need for bushings and adhesive is eliminated, reducing weight and manufacturing complexity.

Method 200 includes securing the axial sides of the seal carrier to respective flanges with fasteners, for example, fasteners 114, inserted through the through holes of the flanges and the seal carrier, as shown in box 206. Securing the axial sides of the seal carrier to respective flanges includes placing a washer, for example, washer 124, opposite each flange across the seal carrier, also shown in box 206. Each washer includes at least two through holes, for example, through holes 130, for receiving the fasteners. The through holes of each washer correspond to the pair of through holes on each flange.

The methods and systems of the present disclosure, as described above and shown in the drawings, provide for gas turbine engines and vane stages with superior properties including reduced weight and increased stiffness. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A component of a vane stage, comprising:

a plurality of arcuate vane platforms, each arcuate vane platform of the plurality of arcuate vane platforms having a pair of flanges that extend radially inward from each arcuate vane platform of the plurality of arcuate vane platforms, wherein the pair of flanges are axially spaced apart from one another and from a respective forward end and aft end of each arcuate platform of the plurality of arcuate vane platforms and wherein each flange of the pair of flanges includes at least two through holes;

a vane extending radially outward from each arcuate vane platform of the plurality of arcuate vane platforms;

a seal carrier mounted axially between the pair of flanges of each arcuate vane platform of the plurality of arcuate vane platforms so that inner surfaces of the pair of flanges of each arcuate vane platform of the plurality of arcuate vane platforms interface with outer surfaces of the seal carrier; and a plurality of washers, each washer of the plurality of washers being mounted to the seal carrier opposite to a respective one of each of the pair of flanges of each one of the plurality of arcuate vane platforms across an axial thickness of a respective side of the seal carrier, wherein a portion of the seal carrier located between each washer of the plurality of washers and the respective one of each of the pair of flanges of each one of the plurality of arcuate vane platforms includes at least two through holes extending in an axial direction for receiving fasteners, and wherein each washer of the plurality of washers includes at least two through holes that align with the at least two through holes of the respective one of each of the pair of flanges of each arcuate vane platform of the plurality of arcuate vane platforms and the at least two through holes of the portion of the seal carrier located between each washer of the plurality of washers and the respective one of each of the pair of flanges of each one of the plurality of arcuate vane platforms, wherein a cross-sectional area of a surface of each washer of the plurality of washers that interfaces with a surface of the seal carrier is at least eight times greater in area than a total cross-sectional area of the at least two through holes in the portion of the seal carrier located between each washer of the plurality of washers and the respective one of each of the pair of flanges of each one of the plurality of arcuate vane platforms and each washer of the plurality of washers assists in spreading out fastener pre-load over inwardly facing sides of the seal carrier.

2. The component vane stage as recited in claim 1, wherein each washer of the plurality of washers has a race-track shape.

3. The component as in claim 1, wherein the seal carrier is formed from a different material than the plurality of arcuate vane platforms and the vane extending radially outward from each arcuate vane platform of the plurality of arcuate vane platforms.

4. The component as in claim 3, wherein the seal carrier is formed from a composite material.

5. The component as in claim 3, wherein the seal carrier is formed from a composite material and the vane extending radially outward from each arcuate vane platform of the plurality of arcuate vane platforms is formed from titanium.

6. The component as in claim 1, wherein the seal carrier is secured to the pair of flanges of each arcuate vane platform of the plurality of arcuate vane platforms without a bushing or an adhesive.

7. The component as in claim 6, wherein the seal carrier is formed from a different material than the plurality of arcuate vane platforms and the vane extending radially outward from each arcuate vane platform of the plurality of arcuate vane platforms.

8. The component as in claim 7, wherein the seal carrier is formed from a composite material.

9. The component as in claim 7, wherein the seal carrier is formed from a composite material and the vane extending radially outward from each arcuate vane platform of the plurality of arcuate vane platforms is formed from titanium.

10. The component as in claim 1, wherein the seal carrier has a first leg extending from a base, and a second leg spaced apart from the first leg, the second leg extending from the base.

11. The component as in claim 1, wherein the seal carrier has a "U" shaped configuration.

12. A vane stage comprising a plurality of components as recited in claim 1.

13. A method for constructing a component of a vane stage comprising:

sliding a seal carrier between flanges of a plurality of arcuate platforms, wherein the flanges of each of the plurality of arcuate platforms are axially spaced apart from one another and extend radially inward from each of the plurality of arcuate platforms, wherein each flange of the flanges of the plurality of arcuate platforms includes at least a pair of through holes, and wherein each flange of the flanges of the plurality of arcuate platforms interfaces with a respective axial side of the seal carrier;

drilling through holes in the respective axial side of the seal carrier by using the pair of through holes of each flange of the flanges of the plurality of arcuate platforms as guides;

placing a plurality of washers opposite each flange of the flanges of the plurality of arcuate platforms across a portion of the seal carrier, wherein each washer of the plurality of washers includes at least two through holes for receiving fasteners for securing the respective axial side of the seal carrier to a respective flange of the flanges of the plurality of arcuate platforms, wherein the at least two through holes of each washer of the plurality of washers corresponds to the pair of through holes of each flange of the flanges of the plurality of arcuate platforms; and securing the respective axial side of the seal carrier to a respective flange of the flanges of the plurality of arcuate platforms with fasteners inserted through the through the holes in the respective axial side of the seal carrier and the pair of through holes of each flange of the flanges of the plurality of arcuate platforms, wherein a cross-sectional area of a surface of each washer of the plurality of washers that interfaces with a surface of the seal carrier is at least eight times greater in area than a total cross-sectional area of the at least two through holes in a portion of the seal carrier located between each washer of the plurality of washers and a respective one of each of the pair of flanges of each one of the plurality of arcuate vane platforms and each washer of the plurality of washers assists in spreading out fastener pre-load over inwardly facing sides of the seal carrier.

* * * * *